US006074494A

United States Patent [19]

Miura et al.

[11] Patent Number: 6,074,494

[45] Date of Patent: Jun. 13, 2000

[54] SURFACE NITRIDING METHOD OF AN ALUMINUM MATERIAL, AND AN AUXILIARY AGENT FOR NITRIDING

[75] Inventors: Hirohisa Miura; Yasuhiro Yamada, both of Toyota; Haruzo Katoh, Osaka, all of Japan

[73] Assignees: Toyota Jidosha Kabushiki Kaisha, Toyota; Toyo Aluminium Kabushiki Kaisha, Osaka, both of Japan

[21] Appl. No.: 08/849,555

[22] PCT Filed: Oct. 2, 1996

[86] PCT No.: PCT/JP96/02912

§ 371 Date: Jun. 2, 1997

§ 102(e) Date: Jun. 2, 1997

[87] PCT Pub. No.: WO97/13002

PCT Pub. Date: Apr. 10, 1997

[30] Foreign Application Priority Data

Oct. 2, 1995 [JP] Japan ..... 7-255115
Mar. 13, 1996 [JP] Japan ..... 8-056529

[51] Int. Cl.[7] ..... C23C 8/24

[52] U.S. Cl. ..... 148/238; 148/27; 148/441; 148/440; 148/439; 420/533; 420/542; 420/513; 420/521; 420/407; 420/411

[58] Field of Search ..... 148/206, 212, 148/238, 420, 439, 440, 441, 27; 420/542, 407, 533, 411, 513, 521

[56] References Cited

U.S. PATENT DOCUMENTS 3,615,372 10/1971 Braithwaite .
4,451,302 5/1984 Prescott et al. .
4,909,862 3/1990 Tachikawa et al. .
5,053,085 10/1991 Masumoto et al. ..... 148/402
5,221,376 6/1993 Masumoto et al. ..... 148/403
5,272,015 12/1993 Hamdi et al. ..... 428/472
5,304,260 4/1994 Aikawa et al. ..... 148/403
5,514,225 5/1996 Yamada et al. ..... 148/238

FOREIGN PATENT DOCUMENTS 60-211061 10/1985 Japan .
7-166321 6/1995 Japan .

*Primary Examiner*—John Sheehan
*Attorney, Agent, or Firm*—Oliff & Berridge, PLC

[57] ABSTRACT

This invention aims to provide a nitriding method of forming a relatively thick nitride layer on the surface of an aluminum material containing silicon, and an auxiliary agent for nitriding. By using a nitriding auxiliary agent mainly comprising aluminum containing a metal such as lithium or boron, which has a high bonding strength with oxygen, coexists with silicon to form substantially no silicide, or a nitriding auxiliary agent mainly comprising an Al—Mg—Cu alloy or an Mg—Zn—Cu alloy, heat treatment is applied by nitrogen gas with the aluminum material to be nitrided contacted with the nitriding auxiliary agent. Hence, a thick nitride layer can be easily formed even on the surface of an aluminum material containing silicon, and this is most suitable to surface nitride aluminum-silicon alloys, which possess superior castability.

18 Claims, 4 Drawing Sheets

(X50)

(X100)

SURFACE NITRIDING METHOD OF AN ALUMINUM MATERIAL, AND AN AUXILIARY AGENT FOR NITRIDING

TECHNICAL FIELD

The present invention relates to a nitriding method of forming a nitride layer on a surface portion of an aluminum material, and a nitriding auxiliary agent used for nitriding.

BACKGROUND ART

As is commonly known, an aluminum material has a lower hardness than steel and the like, and very easily seizes and wears away when it slides against steel and the like. Therefore, various surface treatments of aluminum materials using metal plating, spray forming, and anodizing have been studied and practiced. These surface treatments are mainly to form an aluminum oxide layer on the surface of an aluminum material. Although nitriding has been attempted, nitride layers formed on the surface are thin, and satisfactory surface nitrided aluminum base materials have not been obtained. This is supposed to be because an aluminum material is a metal which is very active and easily oxidized, and always has some oxide layer on the surface.

The present inventors proposed a nitriding method comprising contacting at least part of the surface of an aluminum material with a nitriding auxiliary agent including aluminum powder, and with keeping this state, nitriding the surface of the aluminum material by an atmospheric gas substantially comprising nitrogen gas at a nitriding temperature which is equal to or lower than a melting point of the aluminum material in the publication of Japanese Unexamined Patent Publication (KOKAI) No.H7-166321. In this method, when aluminum powder used as a nitriding auxiliary agent is contacted with nitrogen gas at a predetermined temperature, the aluminum powder is nitrided in itself, and at this time, nascent nitrogen (N*) generates and diffuses into the interior of the aluminum material, thereby forming a nitride layer.

It is desirable that an aluminum material to be nitrided or an aluminum material constituting a nitriding auxiliary agent contains magnesium, because nitriding is promoted, nitriding speed is increased, and a thicker nitride layer is formed. This is supposed to be because magnesium serves as an oxygen getter.

In regard to aluminum, although pure aluminum is used alone, aluminum alloys containing copper, zinc, silicon, magnesium or the like in addition to aluminum are used industrially. In particular, as aluminum alloys used as castings, aluminum-silicon alloys are often used because of excellent castability (fluidity).

On the other hand, in the aforementioned surface nitriding method of an aluminum material, in the case where aluminum alloy powder containing magnesium, which has a strong nitriding power, is used as a nitriding auxiliary agent, and nitriding treatment is applied to an aluminum alloy material by using pure nitrogen gas at a nitriding temperature of 500 to 550°C. for five to ten hours, a nitride layer of 50 to 300 $\mu$m is obtained. In the case where an aluminum alloy material to be nitrided contains silicon, however, even if nitriding treatment is applied under the same nitriding conditions, the thickness of an obtained nitride layer is about one fifth to one tenth of that in the case where an aluminum alloy material containing no silicon is used.

SUMMARY OF THE INVENTION

It is an object of the present invention to provide a method of nitriding an aluminum material in which a thick nitride layer can be relatively easily formed on such an aluminum alloy material containing silicon, and a nitriding auxiliary agent used in nitriding.

It is another object of the present invention to provide a method of nitriding an aluminum material in which nitriding can be done at a lower temperature than conventional nitriding temperatures (500 to 550° C.), and in which a nitride layer of the same depth can be obtained in a shorter nitriding time, and a nitriding auxiliary agent used in nitriding.

The present inventors have researched from various viewpoints on the cause why aluminum alloy materials containing silicon are hardly nitrided, and have concluded that the cause lies in the following two points.

1) When, after nitriding, a nitride layer of an aluminum material containing silicon is observed, aluminum portions are nitrided, but silicon is not nitrided and exists as a single substance. Hence, silicon decreases the width of passages through which nitrogen atoms invade from the surface, and decreases the depth of the nitride layer.
2) Silicon has a high bonding strength with magnesium, and forms magnesium silicide ($Mg_2Si$). Therefore, silicon combines with magnesium contained in a nitriding auxiliary agent or a material to be nitrided, and an oxygen getter effect which magnesium as a single substance should have given is eliminated.

Even when aluminum alloy powder containing 20% magnesium is used as a conventional nitriding auxiliary agent, this nitriding auxiliary agent has a melting point of approximately 560° C. Accordingly, when nitriding treatment is applied at a temperature of 500 to 550° C., the reaction just after nitriding starts is a "solid phase to solid phase" reaction. In the case of using a nitriding auxiliary agent which has a molten body at a nitriding temperature, the reaction just after nitriding starts is a "liquid phase to solid phase" reaction. So, the reactability is remarkably improved as compared with the "solid phase to solid phase" reaction, and formation of a deep nitride layer can be expected even when nitriding is disturbed by silicon.

Aluminum alloys and magnesium alloys are listed as a metal which acts on aluminum as a nitriding auxiliary agent and which has a molten body at a temperature of 550° C. or less: It is known that there are some alloy materials which have a molten body at 400° C.

Another means for dissolving the problems is to add, to a nitriding auxiliary agent or a material to be nitrided, a metal which exercises an oxygen getter effect without being interrupted by silicon. The present inventors have found that lithium and boron are suitable as an element which has a superior bonding strength with oxygen and a small bonding strength with silicon, and completed the present invention.

A method of nitriding an aluminum material and a nitriding auxiliary agent according to the present invention are characterized in using a nitriding auxiliary agent containing first metal powder which has a lower melting point than a nitriding temperature and makes an exothermic reaction with nitrogen gas.

A method of nitriding an aluminum material and a nitriding auxiliary agent according to a second aspect of the present invention are characterized in using a nitriding auxiliary agent containing aluminum, and a third element which has a high bonding strength with oxygen and coexists with silicon to form substantially no silicide.

A method of nitriding an aluminum material according to a third aspect of the present invention is characterized in using, as an aluminum material, an aluminum alloy containing not less than 0.5 wt. % of the lithium element.

As first metal powder which has a lower melting point than a nitriding temperature and makes an exothermic reaction with nitrogen gas, it is possible to employ Al—Mg alloy powder comprising 80 to 30 wt. % aluminum and 20 to 70 wt. % magnesium, Al—Mg—Cu alloy powder comprising 20 to 70 wt. % magnesium, not more than 25 wt. % copper, and the balance of aluminum, Mg—Zn alloy powder comprising 40 to 60 wt. % magnesium and 60 to 40 wt. % zinc, Mg—Zn—Cu alloy powder comprising 60 to 40 wt. % zinc, not more than 30 wt. % copper and the balance of magnesium, and the like, based on 100 wt. % the total amount of alloy powder. The oxygen content of the first metal powder is preferably 0.1 wt. % or less, and it is preferable to employ powder which has little oxide on the surface.

Second metal powder which has a higher melting point than a nitriding temperature and makes an exothermic reaction with nitrogen gas can be added to a nitriding auxiliary agent containing first metal powder. Aluminum, copper, silicon and iron can be listed as an element constituting the second metal powder. The second metal powder serves to suppress nitriding of the first metal powder, and is used when control of nitriding speed is desired. It is preferable that the mixing ratio of the second metal powder is not more than the mixing ratio of the first metal powder by weight.

The nitriding auxiliary agent used in the method of nitriding an aluminum material according to the second aspect of the present invention contains aluminum, and a third element which has a high bonding strength with oxygen, and forms substantially no silicide with silicon. At least one element of lithium and boron is preferably employed as a third element. Although these metals in the form of single substance powder or alloy powder with other metals can be used by being mixed with aluminum powder, it is practical to use these metals in the form of aluminum alloy powder containing the third element. The mixing ratio of lithium is preferably not less than 0.5 wt. %, and more preferably from about 1.0 to 4.0 wt. %. The mixing ratio of boron is preferably 0.1 wt. % or more.

When aluminum-lithium alloy powder alone is used as metal powder of a nitriding auxiliary agent, the effect of promoting nitriding is slightly insufficient. Hence, it is preferable to use aluminum-magnesium alloy powder along with the aluminum-lithium alloy powder. The aluminum-magnesium alloy desirably comprises 98 to 30 wt. % aluminum and 2 to 70 wt. % magnesium.

An element which makes an exothermic reaction with nitrogen gas, such as Ti, Zr, Ta, B, Ca, Si, Ba, Cr, Fe, V, and the like, can be added as an additional element, besides aluminum, and the third element which has a high bonding strength with oxygen, and forms substantially no silicide with silicon.

Metal powder constituting a nitriding auxiliary agent is nitrided prior to an aluminum material to be nitrided, and owing to generation of nascent nitrogen gas and generation of a large amount (approximately 300 kJ/mol) of reaction heat, the metal powder serves to cause a nitriding reaction on the interior of the contacted aluminum material to be nitrided. For this reason, it is preferable that the metal powder constituting the nitriding auxiliary agent has a large specific surface area in order to enhance reactability. Specifically, it is preferable that the metal powder has the particle size of approximately 3 to 200 $\mu$m. The powder may be in the form of granular particle, foil, or a mixture thereof. The surface area of the powder is preferably about 0.1 to 15 $m^2/g$, and more preferably about 0.4 to 10 $m^2/g$ in view of reactability.

A film forming agent used in a nitriding auxiliary agent serves to bond the metal powder on a material to be nitrided. This film forming agent may be constituted by a caking agent comprising an organic high molecular compound which has tackiness and thermally decomposes at 400 to 600° C. to leave no decomposition residue, and a solvent. Polybutene resin, polyvinyl butyral, polycaprolactum, nitrocellulose, ethyl cellulose, polyethylene oxide and the like are recommended as an organic high molecular compound constituting the caking agent. Besides, it is desirable to add a small amount of an agent for exhibiting thixotropy.

Any solvent can be employed as long as these organic high molecular compounds dissolve in or are dispersed in it, and the solvent forms paste in which metal powder is dispersed.

It is preferable that the composition of the auxiliary agent for nitriding an aluminum material comprises 5 to 70 wt. % of metal powder which virtually promotes nitriding, 1 to 30 wt. % of a caking agent, and the balance of a solvent.

The nitriding auxiliary agent does not have to include a caking agent or a solvent.

An aluminum material to be nitrided may have any form such as powder, plates, castings. The aluminum material to be nitrided may have any alloy composition.

In particular, an aluminum material containing not less than 0.5% by weight of lithium is easily nitrided since the material to be nitrided contains an oxygen getter. Even an aluminum material containing silicon in addition to not less than 0.5 wt. % of lithium can be easily nitrided owing to the effect of lithium.

As for a method of contacting the surface of an aluminum material with a nitriding auxiliary agent, it is possible to bury the aluminum material in metal powder constituting the nitriding auxiliary agent. It is also possible to cover the surface of the aluminum material with metal powder constituting the nitriding auxiliary agent. As mentioned above, it is further possible to use the nitriding auxiliary agent in the form of paste or paint, and coat the surface of the aluminum material with it. Preferably, this coating produces a paint film of 5 to 1000 $\mu$m in thickness. As a coating method, brush coating, dipping, spray coating, roller painting and so on can be employed.

A nitriding auxiliary agent for screen printing, spray coating, or injection painting can be prepared, for example, as follows. First of all, a metal material with a predetermined composition is formed into powder in a predetermined particle size by dissolving and atomizing, or pulverizing. Second metal powder is added if necessary, and stearic acid, oleic acid, or the like is further added, and they are mixed by a ball mill, whereby metal powder is formed into flakes. Subsequently, the flakes are transferred into a kneading machine, and a thickener, an adhesive, an agent for exhibiting thixotropy, a solvent and so on are added and they are kneaded into a nitriding auxiliary agent in the form of paint. In obtaining metal powder, care must be taken not to oxidize the surface of the powder.

As an atmospheric gas for nitriding, nitrogen gas is used. The moisture content and oxygen gas content of this nitrogen gas are preferably small Inert gas such as argon gas causes no problem even if contained. The purity of nitrogen gas is measured by the dew point, and desirably it is −50° C. or less (moisture content: $6\times10^{-6}$ volume % or less).

In regard to nitriding temperature, high temperature is preferred in view of reactability. The aluminum material, however, must be nitrided virtually in a solid phase. In the case where formation of a very deep nitride layer is not desired, or in the case where a decrease in distortion due to thermal treatment is desired, nitriding is preferably done at a low temperature. In general, nitriding is done at a temperature in the range from about 400 to 600° C. for 2 to 20 hours.

The heat treatment furnace used in this surface nitriding method may be a quite ordinary furnace such as a quartz tubular furnace, a bell type atmosphere furnace, a box type atmosphere furnace.

The depth of a nitride layer obtained by the surface nitriding method of an aluminum material and by using the nitriding auxiliary agent according to the present invention is at least 5 μm or more and approximately 2000 at maximum. The surface hardness of this nitride layer is in the range from about mVH (micro Vickers Hardness) 250 to 1200. This nitride layer is constituted by a mixed phase of aluminum and aluminum nitride. Aluminum nitride has an acicular shape mainly with very small micro diameters of 5 to 50 nm. When the ratio of aluminum nitride is larger, the nitride layer attains a higher Vickers hardness.

In the nitriding method according to the present invention, when metal powder is constituted by at least one selected from the group consisting of Al—Mg alloy powder comprising 80 to 30 wt. % aluminum and 20 to 70 wt. % magnesium, Al—Mg—Cu alloy powder comprising 80 to 30 wt. % aluminum, 20 to 70 wt. % magnesium and not more than 25 wt. % copper, Mg—Zn alloy powder comprising 40 to 60 wt. % magnesium and 60 to 40 wt. % zinc, and Mg—Zn—Cu alloy powder comprising 40 to 60 wt. % magnesium, 60 to 40 wt. % zinc, and not more than 30 wt. % copper, based on 100 wt. % of the total amount of alloy powder, the metal powder partially dissolves at a nitriding temperature, and promptly reacts with nitrogen gas in the atmosphere to form a nitride. Nascent nitrogen ($N^*$) generating at this time remarkably promotes nitriding. Therefore, a nitride layer can be easily formed at a knock-pin nitriding temperature of 500° C. or less.

When adding a third element such as lithium and boron which has a high bonding strength with oxygen and coexists with silicon to form substantially no silicide, the third element serves to weaken the nitriding suppressing effect of silicon contained in an aluminum material to be nitrided. Consequently, a thick nitride layer can be formed even on the surface of an aluminum material containing silicon.

Besides, by adding 0.5 wt. % or more of lithium to an aluminum material to be nitrided, it becomes possible to make an aluminum material which can be easily nitrided.

DETAILED DESCRIPTION OF THE INVENTION

Figure 1:
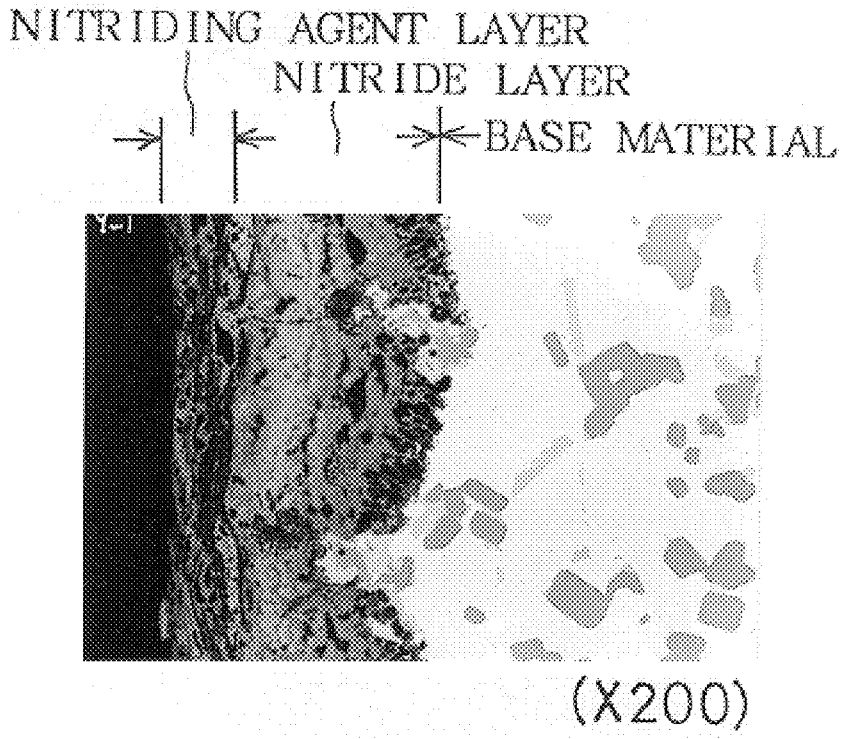
FIG. 1 is a microphotograph showing a metal structure in cross section of a surface portion of an aluminum material on which a nitride layer is formed in a third preferred embodiment.

Hereinafter, the present invention will be concretely described by way of preferred embodiments.

(1) Preparation of Nitriding Auxiliary Agents

Alloy powders with the composition shown in Table 1 were respectively produced by grinding, with a miorogrinder, available aluminum alloy plates on the market or cast materials with required composition. Then these alloy powders were sieved with a 150-mesh screen. 30 parts by weight of the sieved alloy powders were mixed with 10.0 parts by weight of ethylcellulose N-7 (produced by Hercules Co., Ltd.) and 60 parts by weight of a butyl glycol-based solvent (produced by Nippon Nyukazai Co., Ltd.) and were mixed to prepare five kinds of nitride auxiliary agents, Nos.1 to 5 shown in Table 1.

TABLE 1

| NITRIDING AUXILIARY AGENT | METAL POWDER COMPOSITION |
|---|---|
| No. 1 | Al-33Mg-3Cu (casting) |
| No. 2 | Mg-53Zn-1Cu (casting) |
| No. 3 | Al-2.5Li-1.3Cu-1Mg (AA8090 on the market) |
| No. 4 | mixed powder in equal weight of Al-2.5Li-1.3Cu-1Mg and Al-2.5Mg |
| No. 5 | Al-50Mg (casting) |

(2) Nitriding Treatment

Aluminum materials to be nitrided were prepared by cutting test specimens of 20 mm×30 mm in size and 10 mm in thickness from commercial aluminum alloy plates or cast alloys, and polishing the upper surface of the test specimens.

Nitriding was done at predetermined nitriding temperatures for 10 hours each, after each of the above nitriding auxiliary agents was applied in a thickness of 50 μm on the polished surface of each aluminum material to be nitrided. As for nitriding conditions, 99.99% pure nitrogen gas was introduced into a furnace at a flow rate of 1 liter per minute, and the dew point in the furnace was kept at −40° C. or less.

(First Preferred Embodiment)

Of Al—Si alloys, 4 kinds of Al—Si alloys containing 0 wt. %, 7 wt. %, 12 wt. %, or 17 wt. % of silicon were employed as aluminum materials to be nitrided. As a nitriding auxiliary agent, auxiliary agent No.1 in Table 1 was employed. Metal powder (Al—33Mg—3Cu alloy powder) used for auxiliary agent No.1 had a melting point of 450° C., and aimed nitriding of the aforementioned four kinds of aluminum materials to be nitrided at a temperature of 500° C. or less. Nitriding treatment was applied at a nitriding temperature of 495° C.

Owing to this nitriding, nitride layers were formed on the surface of the aluminum materials to be nitrided and containing 0 wt. %, 7 wt. %, 12 wt. %, or 17 wt. % of silicon. The depth of the obtained nitride layers and the surface hardness of the nitride layers are shown in Table 2.

It is seen from Table 2 that all of the aluminum materials to be nitrided had nitride layers of 70 μm or more, and that an aluminum material with a higher Si content exhibited a higher hardness. Therefore, it is clear that when Al—Mg—Cu alloy powder with the above composition was used as main metal powder of the nitriding auxiliary agent in this preferred embodiment, nitride layers were formed on the various Al—Si alloys having different Si contents in the range from 0 to 17 wt. % at a nitriding temperature of 500° C. or less.

(Second Preferred Embodiment)

Of various non-heat treated aluminum alloys, three kinds of alloys of JIS (Japanese Industrial Standards) 1100, JIS 5052, and JIS 6061 were employed as aluminum materials to be nitrided. As a nitriding auxiliary agent, auxiliary agent No.2 in Table 1 was employed. The metal powder (Mg—53Zn—1Cu alloy powder) used for auxiliary agent No.2 had a melting point of 350° C., and aimed nitriding of the aforementioned three kinds of aluminum materials at lower temperatures. Nitriding was done at a nitriding temperature of 460° C.

Owing to this nitriding, nitride layers were formed respectively on the surface of the materials of JIS 1100, JIS 5052, and JIS 6061. The depth of the obtained nitride layers and the surface hardness of the obtained nitride layers are shown in Table 2.

Figure 4:
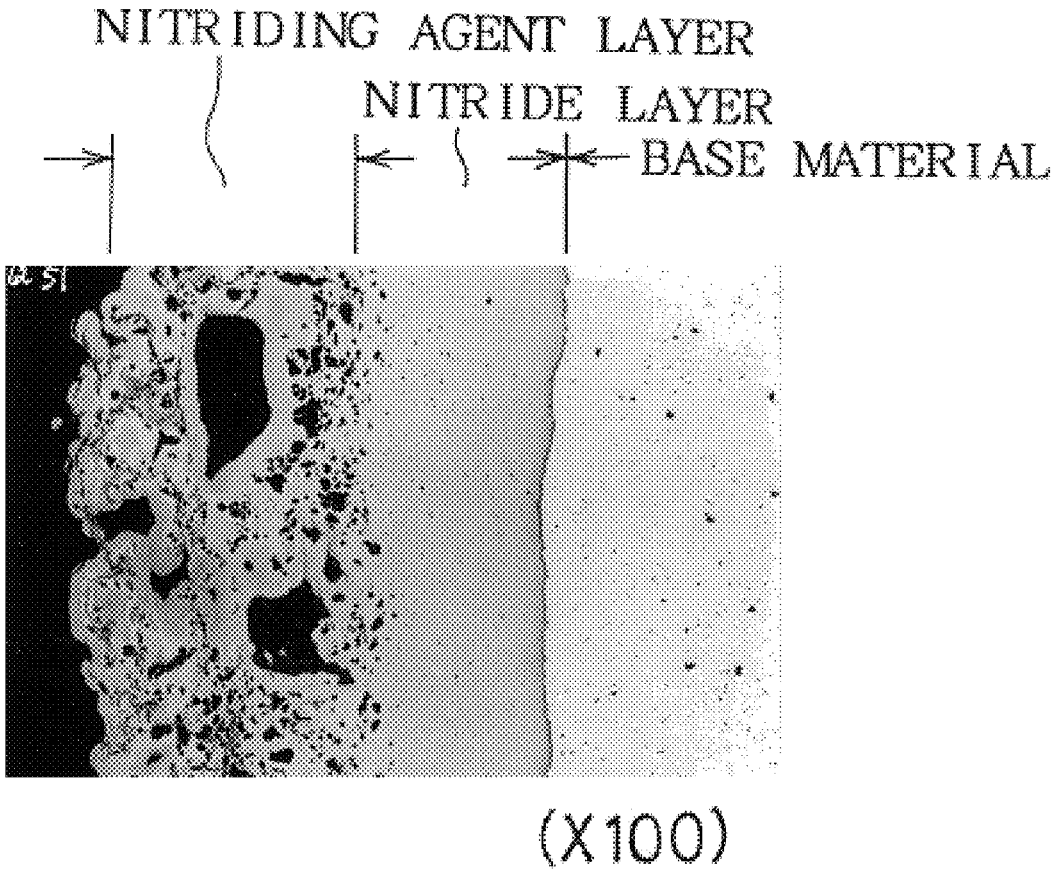
FIG. 4 is a microphotograph showing a metal structure in cross section of another surface portion of the aluminum material on which a nitride layer is formed in the second preferred embodiment.

In the case of the material of JIS 1100, which is pure aluminum, the nitride layer had a small thickness of 20 to 50 um, and a hardness of HV 143 to 330. Besides, after the aluminum material of JIS 5052 was cut in section, the obtained nitride layer was observed with a metallurgical microscope. The cross sectional microphotograph is shown in FIG. 4. It is apparent that continuously from a nitriding auxiliary agent layer of about 50 um, there is a smooth nitride layer of 100 to 120 um in thickness and HV 150 to 322 in hardness, which continued into an inner structure with a narrow boundary sandwiched. Therefore, it is clear that by including Mg—53Zn—1Cu 1Cu alloy powder with the above composition in a nitriding auxiliary agent in this preferred embodiment, nitride layers were formed on non-heat treated aluminum alloy materials at a nitriding temperature of 500° C. or less.

TABLE 2

| preferred Embodiment | NITRIDING CONDITION | MATERIAL TO BE NITRIDED | DEPTH OF NITRIDE (um) | HARDNESS OF NITRIDE LAYER (HV) |
|---|---|---|---|---|
| 1 | 495° C. x 10 Hr | Al- 0Si | 80–120 | 292–360 |
| | | Al- 7Si | 70– 80 | 300–421 |
| | | Al-12Si | 120–150 | 592–691 |
| | | A1-17Si | 130–210 | 606–665 |
| 2 | 460° C. x 10 Hr | JIS1100 | 20– 50 | 143–330 |
| | | J1S5052 | 100–120 | 150–322 |
| | | J1S6061 | 50– 80 | 172–366 |

(Third Preferred Embodiment)

As an aluminum material to be nitrided, a die cast alloy of JIS ADC14 containing 17 wt. % Si, 4.5 wt. % Cu, and 0.5 wt. % Mg was employed. As a nitriding auxiliary agent, auxiliary agent No.3 in Table 1 was used. Auxiliary agent No.3 was constituted by aluminum alloy powder containing 2.5 wt. % Li, 1.3 wt. % Cu, and 1 wt. % Mg, and aimed nitriding of high-Si aluminum materials. The nitriding temperature was set at 495° C., which is recommended as a solid solution treatment temperature of JIS ADC14.

Owing to this nitriding, a nitride layer was formed on the entire upper surface of the aluminum material. After the aluminum material was out in section, the obtained nitride layer was observed with a metallurgical microscope. The cross sectional microphotograph is shown in FIG. 1.

In FIG. 1, a nitride layer is observed as a slightly dark portion in the shape of fine clouds (the original nitride layer is observed in brown) on an inner white portion with gray spots (an aluminum-silicon structure). A darker portion as an uppermost layer is nitride hardened portions of the nitriding auxiliary agent of about 60 um in thickness and HV 420 in hardness. The nitride layer had a depth of 100 to 130 um, and a hardness of HV 542 to 574. Primary crystal silicon portions in the nitride layer were not nitrided and are identified as gray islands in the figure.

(Fourth Preferred Embodiment)

As an aluminum material to be nitrided, an aluminum-lithium-silicon alloy containing 2.5% Li and 12% Si was employed. As a nitriding auxiliary agent, auxiliary agent No.5 (Al-50 wt. % Mg) in Table 1 was employed. The nitriding temperature was set at 520° C.

Figure 2:
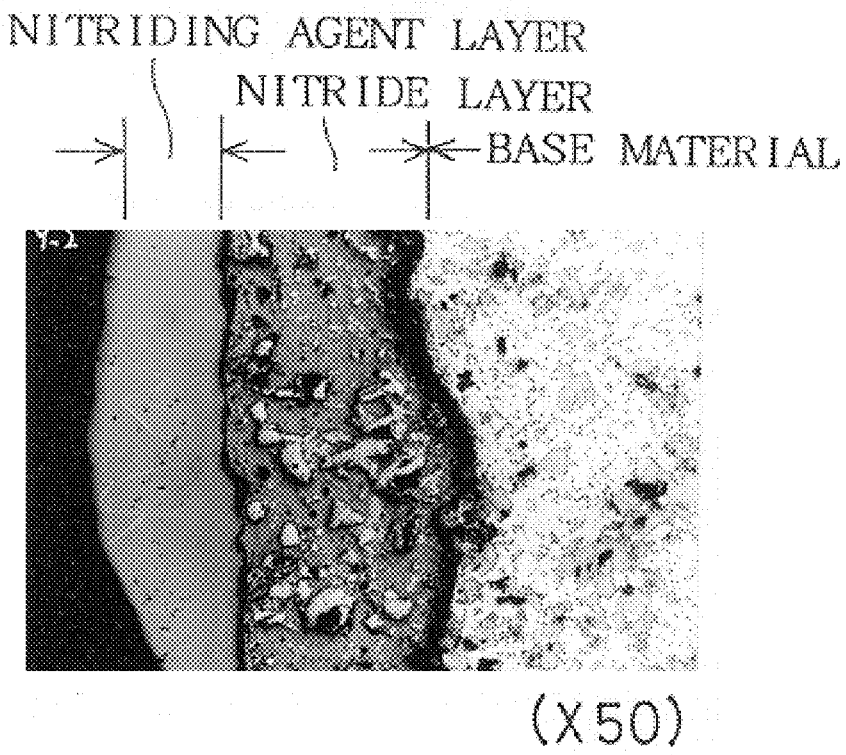
FIG. 2 is a microphotograph showing a metal structure in cross section of a surface portion of an aluminum material on which a nitride layer is formed in a fourth preferred embodiment.
Figure 3:
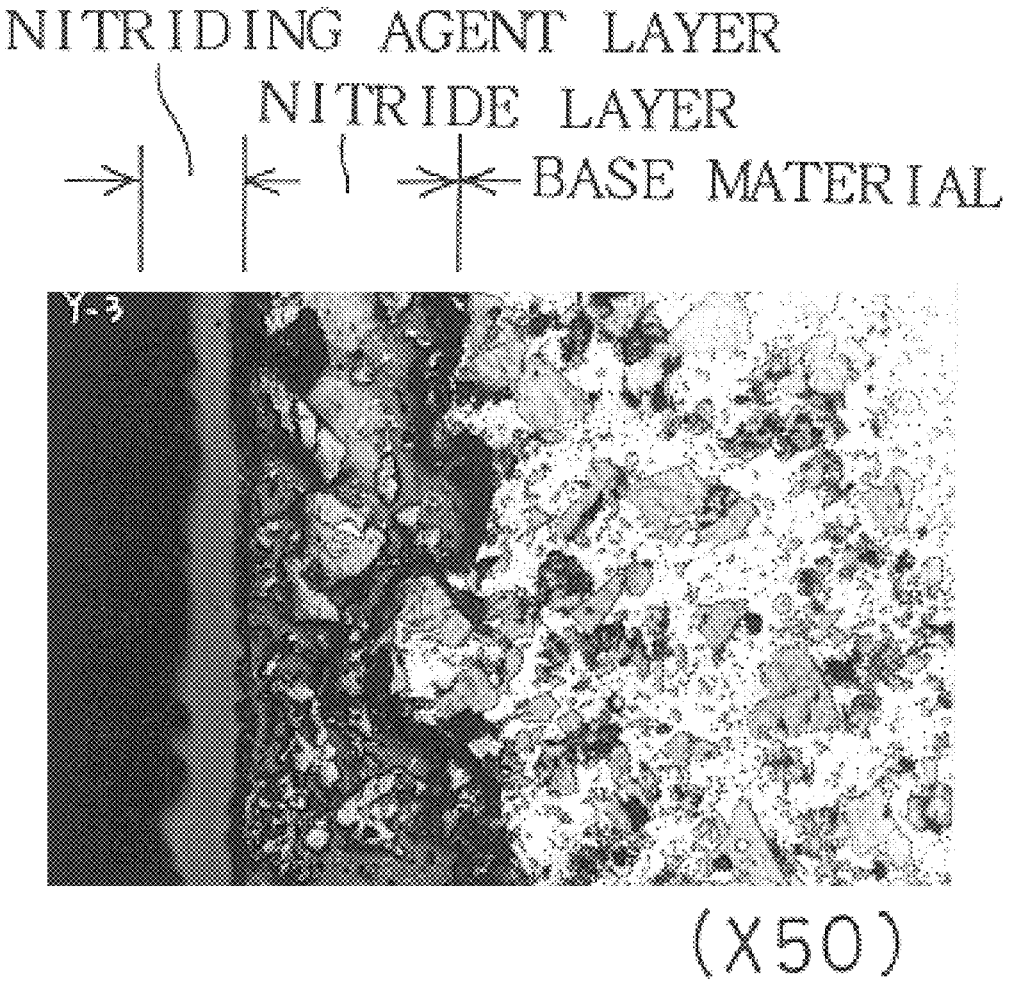
FIG. 3 is a microphotograph showing a metal structure in cross section of a surface portion of an aluminum material on which a nitride layer is formed in a fourth preferred embodiment.

Owing to this nitriding, a nitride layer was formed on the entire upper surface of the aluminum material. After the aluminum material was cut in section, the obtained nitride layer was observed with a metallurgical microscope. Microphotographs of the nitride portion of the aluminum-lithium-silicon alloy (at two points) are shown in FIGS. 2 and 3. X-ray analysis of each element of N, Al, and Si in the cross section shown in FIG. 3 was done with using an electron probe microanalyzer (EPMA). A chart of element strength is shown in FIG. 5.

In the cross section shown in FIG. 3, a thin nitriding auxiliary agent layer is seen and under this there is a nitride layer. This nitride layer has a thickness of 400 to 500 um. In the cross section shown in FIG. 2, a thick nitriding auxiliary agent layer is seen, and under this, a nitride layer of 400 to 500 um in thickness is seen. Both the nitride layers shown in FIGS. 2 and 3 are considerably thicker than ordinary ones.

The hardness of the nitride layer of the aluminum-lithium-silicon alloy was in the range from HV 648 to 744, which were higher than the hardness (HV 542 to 574) of the first nitride layers formed on the aluminum-silicon alloy materials containing no lithium and the nitride layers formed in the first preferred embodiment. This can be explained also by a relatively high nitrogen concentration shown in the element strength chart of FIG. 5, which will be described below.

Figure 5:
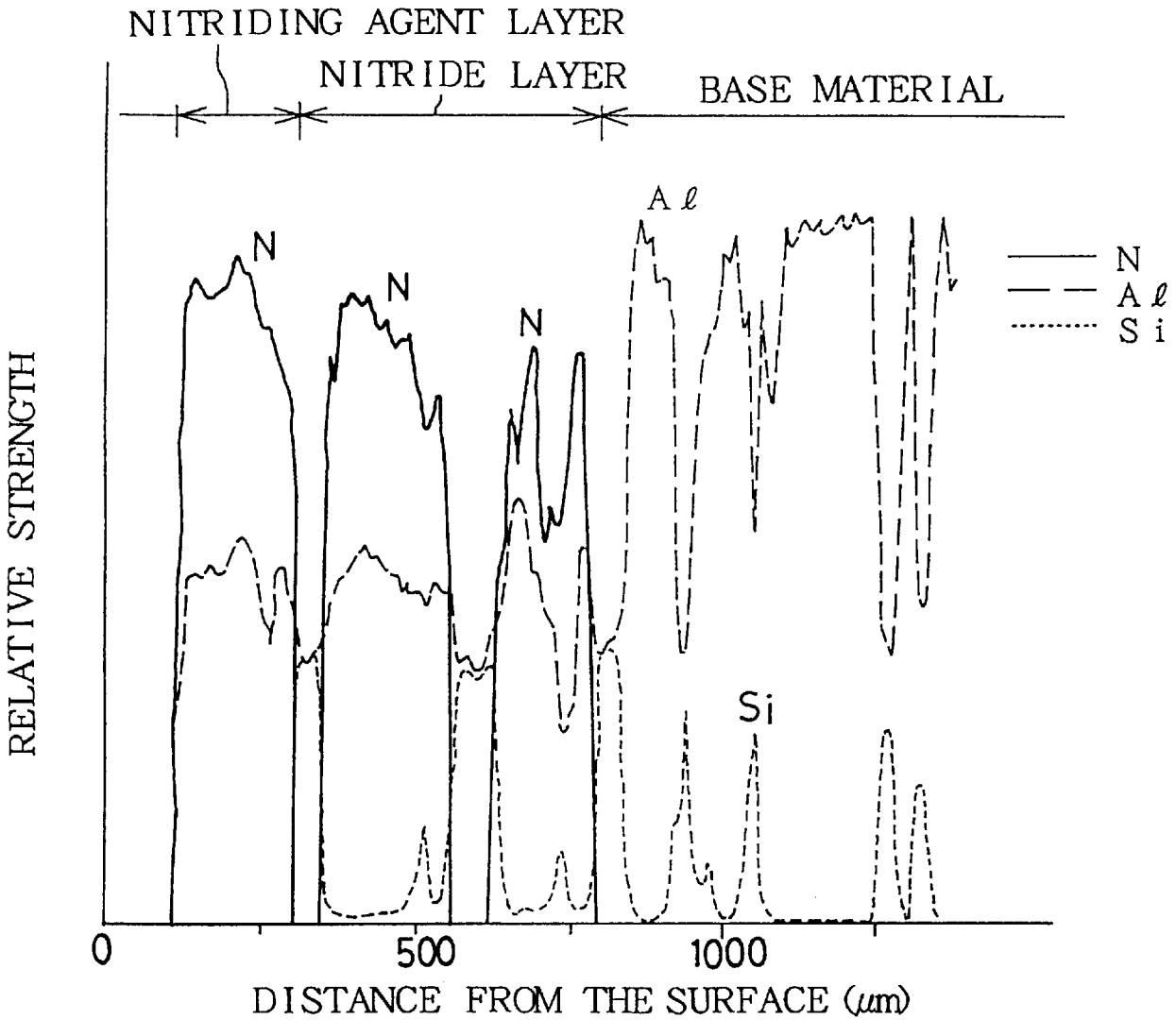
FIG. 5 is a chart showing strength of each element of N, Al and Si, which was obtained by X-ray analysis with an EPMA, in the cross section of the surface portion of the aluminum material shown in FIG. 3 in the fourth preferred embodiment.

FIG. 5 shows each element strength (relative element concentration) of nitrogen, aluminum and silicon measured in the direction from the nitride surface to the inner aluminum base material. The nitrogen strength is high in the nitriding auxiliary agent layer (the paste portion) and the nitride layer, and the strength drastically decreases when it goes below the nitride layer. A portion of the nitride layer near the surface has nitrogen concentrations of 15 to 16%, which are higher than nitrogen concentrations of 12 to 14% of the nitride layers formed on the aluminum-silicon alloy materials containing no lithium. The strength of nitrogen extremely decreases at portions where Primary crystal silicon exists. It is assumed from this fact that silicon was not nitrided.

As described in the above, by using lithium-containing alloys as aluminum materials to be nitrided, strong and deep nitride layers can be obtained even under the same nitriding conditions.

By use of an oxygen getter effect of lithium, a strip foil of the aluminum-lithium-silicon alloy employed in this preferred embodiment can be used as an agent for removing oxygen from the inside of a furnace for nitriding by placing it in the furnace.

(Fifth Preferred Embodiment)

As an aluminum material to be nitrided, the alloy of JIS 5052 was employed. As a nitriding auxiliary agent, auxiliary agent No.4 in Table 1 was employed. This nitriding auxiliary agent was prepared by using mixed alloy powder in which Al-2.5 wt. % Li-12 wt. % Si powder and Al-2.5 wt. % Mg alloy powder were mixed in equal amounts. By use of an oxygen getter effect of lithium, this nitriding auxiliary agent aimed a decrease in oxygen content in a nitride layer, when used for non-heat treated aluminum alloys. Nitriding treatment was applied at a nitriding temperature of 520° C.

Owing to this nitriding, a nitride layer of 150 to 200 um in thickness and HV 350 to 500 in surface layer hardness was formed on the surface of the aluminum material to be nitrided. Although the surface layer hardness of this material was almost the same as that of a conventionally nitrided material, a smooth nitride layer of HV 143 to 322 in hardness was formed toward the inner structure.

Possibility of Industrial Utilization

When the surface nitriding method of an aluminum material or the nitriding auxiliary agent according to the present invention is employed, a thick and hard nitride layer can be formed at a low nitriding temperature, as compared with the case where a conventional nitriding auxiliary agent is used. Hence, an aluminum material to be nitrided can attain a decrease in distortion caused by thermal treatment. Further, a thick and hard surface nitride layer can be formed even on an aluminum alloy with a high silicon content. Therefore, the surface nitriding method of an aluminum material or the nitriding auxiliary agent according to the present invention is most suitable as surface treatment of automotive sliding portions which require abrasion resistance, such as sliding contact portions of cylinders, an engine, and annular grooves of pistons.

In addition, in the surface nitriding method of an aluminum material according to the present invention, portions where a nitriding auxiliary agent is not applied are not nitrided. By using this fact, nitriding treatment can be applied only to desired portions.

We claim:

1. A method of nitriding an aluminum material, comprising:

contacting at least a portion of an aluminum material selected from aluminum or aluminum-based alloys with a nitriding auxiliary agent; and nitriding the surface of the aluminum material with a gas consisting essentially of nitrogen gas at a nitriding temperature which is equal to or lower than the melting point of the aluminum material, wherein the nitriding auxiliary agent includes a first metal powder which has a lower melting point than the nitriding temperature and makes an exothermic reaction with the nitrogen gas, the nitriding auxiliary agent forming a liquid phase at the nitriding temperature during the nitriding of the aluminum material.

2. A method of nitriding an aluminum material according to claim 1, wherein the first metal powder is at least one metal powder selected from the group consisting of Al—Mg alloy powder comprising 80 to 30 wt. % aluminum and 20 to 70 wt. % magnesium, Al—Mg—Cu alloy powder comprising 20 to 70 wt. % magnesium, not more than 25 wt. % copper and the balance of aluminum, Mg—Zn alloy powder comprising 40 to 60 wt. % magnesium and 60 to 40 wt. % zinc, and Mg—Zn—Cu alloy powder comprising 60 to 40 wt. % zinc, not more than 30 wt. % copper and the balance of magnesium, based on 100 wt. % of the total amount of alloy powder.

3. A method of nitriding an aluminum material according to claim 1, wherein the nitriding auxiliary agent further includes a second metal powder which has a higher melting point than the nitriding temperature and makes an exothermic reaction with the nitrogen gas.

4. A method of nitriding an aluminum material according to claim 3, wherein the second metal powder comprises at least one element selected from the group consisting of aluminum, copper, silicon, and iron, and the mixing ratio in the nitriding auxiliary agent of the second metal powder is not more than the mixing ratio of the first metal powder by weight.

5. A method of nitriding an aluminum material, comprising:

contacting at least a portion of the surface of an aluminum material selected from aluminum or aluminum alloys with a nitriding auxiliary agent; and nitriding the surface of the aluminum material at a nitriding temperature which is equal to or lower than the melting point of the aluminum material, wherein the nitriding auxiliary agent comprises aluminum and a second element which has a high bonding strength with oxygen and forms substantially no silicide with silicon.

6. A method of nitriding an aluminum material according to claim 5, wherein the second element is lithium, boron or mixtures thereof.

7. A method of nitriding an aluminum material according to claim 5, wherein the aluminum and the second element comprise an alloy.

8. A method of nitriding an aluminum material, comprising:

contacting at least a portion of the surface of an aluminum material selected from aluminum or aluminum-based alloys with a nitriding auxiliary agent; and nitriding the surface of the aluminum material with a gas consisting essentially of nitrogen gas at a nitriding temperature which is equal to or lower than the melting point of the aluminum material, wherein the aluminum material is an aluminum alloy comprising not less than 0.5 wt. % lithium.

9. An auxiliary agent for nitriding an aluminum material selected from aluminum or aluminum-based alloys, wherein the auxiliary agent covers at least a portion of the surface of the aluminum material and promotes formation of a nitride layer on the surface of the aluminum material at a nitriding temperature which is equal to or lower than the melting point of the aluminum material, the auxiliary agent comprising:

a first metal powder which has a lower melting point than the nitriding temperature and makes an exothermic reaction with nitrogen gas, the first metal powder forming a liquid phase at the nitriding temperature during the nitriding of the aluminum material; and a film forming agent that enhances bonding of the first metal powder to the aluminum material, wherein the first metal powder is at least one metal powder selected from the group consisting of Al—Mg—Cu alloy powder comprising 80 to 30 wt. % aluminum, 20 to 70 wt. % magnesium, and not more than 25 wt. % copper, Mg—Zn alloy powder comprising 40 to 60 wt. % magnesium and 60 to 40 wt. % zinc, and Mg—Zn—Cu alloy powder composing 40 to 60 wt. % magnesium, 60 to 40 wt. % zinc and not more than 30 wt. % copper, based on 100 wt. % of the total amount of alloy powder.

10. An auxiliary agent for nitriding an aluminum material selected from aluminum or aluminum-based alloys, wherein the auxiliary agent covers at least a portion of the surface of the aluminum material, and promotes formation of a nitride layer on the surface of the aluminum material at a nitriding temperature which is equal to or lower than the melting point of the aluminum material, wherein the auxiliary agent comprises a metal powder including aluminum and a second element which has a high bonding strength with oxygen and forms substantially no silicide with silicon, and a film forming agent that enhances bonding of the metal powder to the aluminum material.

11. An auxiliary agent for nitriding an aluminum material according to claim 10, wherein the second element is lithium, boron or mixtures thereof.

12. An auxiliary agent for nitriding an aluminum material according to claim 11, wherein the aluminum and the second element comprise an alloy.

13. An auxiliary agent for nitriding an aluminum material selected from aluminum or aluminum-based alloys, wherein the auxiliary agent covers at least a portion of the surface of the aluminum material and promotes formation of a nitride layer on the surface of the aluminum material at a nitriding temperature which is equal to or lower than the melting point of the aluminum material, the auxiliary agent comprising:

a first metal powder which has a lower melting point than the nitriding temperature and makes an exothermic reaction with nitrogen gas;

a second metal powder which has a higher melting point than the nitriding temperature and makes an exothermic reaction with the nitrogen gas; and a film forming agent that enhances bonding of the first metal powder and the second metal powder to the aluminum material.

14. A method of nitriding an aluminum material according to claim 1, wherein the nitriding temperature is less than about 500° C.

15. A method of nitriding an aluminum material according to claim 14, wherein the first metal powder comprises at least one of aluminum and magnesium.

16. A method of nitriding an aluminum material according to claim 1, wherein the first metal powder comprises at least one of aluminum and magnesium.

17. An auxiliary agent for nitriding an aluminum material according to claim 9, wherein the auxiliary agent forms a liquid phase at temperature of less than about 500° C.

18. An auxiliary agent for nitriding an aluminum material according to claim 13, wherein the second metal powder comprises at least one element selected from the group consisting of aluminum, copper, silicon, and iron, and the mixing ratio in the auxiliary agent of the second metal powder is not more than the mixing ratio of the first metal powder by weight.

* * * * *